United States Patent [19]

Priebe et al.

[11] Patent Number: 4,858,537

[45] Date of Patent: Aug. 22, 1989

[54] COMBUSTION METHOD AND APPARATUS

[75] Inventors: William F. Priebe, Midland; Brad R. Milliken, Coahoma; Dennis A. Braaten, Midland, all of Tex.

[73] Assignee: Atlantic Richfield Company, Los Angeles, Calif.

[21] Appl. No.: 294,080

[22] Filed: Jan. 5, 1989

Related U.S. Application Data

[62] Division of Ser. No. 234,765, Aug. 22, 1988.

[51] Int. Cl.[4] ..... F23G 5/00

[52] U.S. Cl. ..... 110/243; 110/238; 110/259; 110/346

[58] Field of Search ..... 110/243, 244, 235, 238, 110/251, 256, 259, 346

[56] References Cited

U.S. PATENT DOCUMENTS

| | | | |
|---|---|---|---|
| 4,116,136 | 9/1978 | Mallek et al. | 110/255 |
| 4,350,101 | 9/1982 | Prudhon et al. | 110/238 |
| 4,592,290 | 6/1986 | Berthiller | 110/346 |
| 4,619,210 | 10/1986 | Kennedy | 110/238 |
| 4,635,573 | 1/1987 | Santen | 110/244 |
| 4,756,258 | 7/1988 | Gilbert | 110/346 |
| 4,785,744 | 11/1988 | Fontaine | 110/235 |

*Primary Examiner*—Henry C. Yuen

*Attorney, Agent, or Firm*—Roderick W. MacDonald

[57] ABSTRACT

A method and apparatus for the combustion of a hydrocarbonaceous material wherein an open topped trough means is provided for containing the hydrocarbonaceous material, at least one of an oxygen containing gas and a fluid fuel is introduced into a lower portion of the trough means to mix with the hydrocarbonaceous material to be combusted in the trough means, and an oxygen containing gas curtain is established around the trough means to pick up at least some combustion products rising from the open top of the trough means, circulate same around the under side of the trough means, and carry same back to the top of the trough means, whereby visible emissions are reduced and at least some particulate solids removed.

5 Claims, 3 Drawing Sheets

COMBUSTION METHOD AND APPARATUS

This is a division, of application Ser. No. 07/234,765, filed 8/22/88.

BACKGROUND OF THE INVENTION

Throughout the United States there are numerous locations where relatively small accumulations of hydrocarbonaceous waste material exist. Many of these accumulations are too small and/or remote to justify anything but treatment at the site with a temporary and highly mobile process and apparatus. Otherwise the waste material must be transfered over public highways with the consequent increase cost and risk to the public in case of an accident.

One disposal procedure that can be employed at a temporary site utilizes filtration techniques. For example, in the case of hydrocarbonaceous oil field waste, the material to be treated is collected at a site and there mixed with diatomaceous earth followed by filtration on a vacuum filter. By this technique, liquids such as water and oil are separated from solids such as heavy organics, sand, silt, and the like. This procedure is expensive and still leaves liquid and solid fractions to be disposed of.

Another procedure employs chemical treatment to neutralize various chemicals in the mixture to be disposed of and solidifies the final liquid to be disposed of. This procedure also is expensive. Further, it provides no shrinkage by volume or weight of the material to be disposed of so that there is a substantial solid disposition problem that accompanies this procedure.

A much more economical and effecient, in terms of both volume and weight shrinkage, is combustion of the hydro-carbonaceous material to be disposed of. However, combustion of hydrocarbonaceous material can yield a substantial amount of visible emissions in the form of black smoke which is not desirable even if this type of disposal is permitted under the laws and regulations of the regulatory bodies that govern the temporary disposal site. Further, particularly in exploration, production and first step processing of crude oil and natural gas, a substantial amount of material to be disposed of is either mixed with a substantial amount of water, or did not initially contain or has since lost the lighter, more readily combustable hydrogen components. Thus, the mixture to be disposed of contains heavy hydrocarbons that are difficult to combust and are sometimes thoroughly mixed with water which reduces the heating value and combustion efficiency to the point where autocombustion is only possible at high temperatures.

Accordingly, simple combustion at the temporary site is not as easy a disposal solution as it appears on first impression. When environxental concern and portability restrictions are imposed on top of this problem, a substantial challenge is presented.

BRIEF SUMMARY OF THE INVENTION

By this invention, a highly mobile device is provided which is not complex and well suited for efficient use at a remote site. The method and apparatus are adapted to initiate and maintain combustion of difficult to burn waste material and can more thoroughly and efficiently burn that material while reducing visible emissions and removing a substantial amount of particulate material. The combustion technique of this invention, while achieving the foregoing advantages, will also, as with other combustion techniques, substantially reduce the volume and weight of the final material to be disposed of in a permanent manner.

Accordingly, this invention provides a method and apparatus of disposing of small amounts of hydrocarbonaceous waste accumulation, even at very remote sites, in an efficient manner and without grave sacrifice in the overall economics.

In accordance with this invention, there is provided a process for the combustion of a hydrocarbonaceous material which contains one or more of water, particulate solids, and the like wherein there is provided an open top trough means for containing the hydrocarbonaceous material to be burned, introducing at least one of an oxygen containing gas and a fluid fuel into a lower portion of the trough means to mix with the hydrocarbonaceous material in the trough means, establishing around the trough means a continuously moving curtain of oxygen containing gas which curtain is designed and adapted (i) to pick up at least some combustion products rising from the open top of the trough means, (ii) circulate same around the under side of the trough means, and (iii) carry same back to the top of the trough xeans. By the proper combination of (i) oxygen containing gas and/or fuel internally of the trough means and (ii) velocity and volume of oxygen containing gas curtain around the trough means, initiation of combustion and thorough burning of the material to be disposed of can be achieved in an efficient manner while at the same time reducing at least visible emissions as evidenced by changing the color and opacity of the smoke produced from black to gray or even white. At the same time particulate solids are removed by separation out in the trough means and/or below the trough means.

Apparatus that can be employed to carry out the foregoing process, includes an open top trough means with upwardly and outwardly diverging wall means, the trough means carrying in a lower portion thereof at least one conduit means for introducing one or more fluids such as an oxygen containing gas, a fluid fuel such as natural gas, and the like, the trough means being disposed between a pair of upstanding spaced apart wall means which are employed to direct the air curtain completely around the trough means to assist in initiating and/or carrying out the combustion cycle, there additionally being employed in the apparatus means for adding new material to be disposed of to the trough means, and means for establishing a curtain of oxygen containing gas completely around the trough means.

Accordingly, it is an object of this invention to provide a new and improved method and apparatus for disposing of hydrocarbonaceous material.

It is another object to provide a new and improved method and apparatus for disposing of waste material in an economic yet environmentally acceptable manner even at remote sites which require highly mobile equipment.

Other aspects, objects and advantages of this invention will be apparent to those skilled in the art from this disclosure and the appended claims.

DETAILED DESCRIPTION OF THE INVENTION

Figure 1:
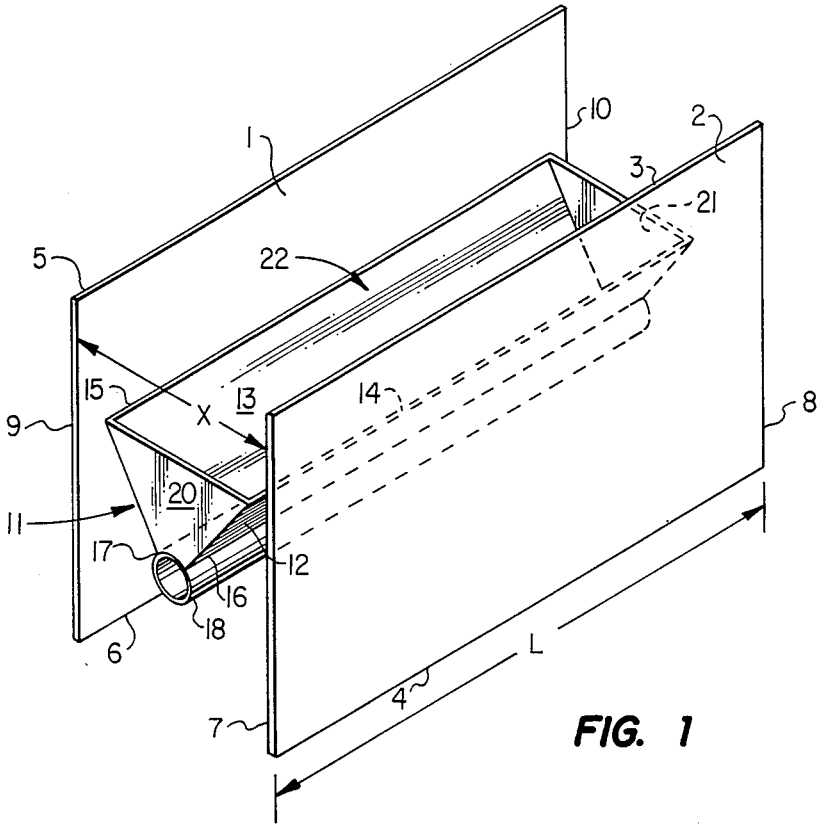
FIG. 1 is an isometric view of only the combustion trough and upstanding spaced apart walls which are employed to direct the curtain of oxygen containing gas around the trough.

FIG. 1 shows a pair of spaced apart, upstanding, elongate wall means having upper and lower essentially horizontally extending edge means 3 and 4, respectively, for wall means 2, and similar upper and lower edge means 5 and 6, respectively, for wall means 1. Upper edge means 3 and lower edge means 4 of wall means 2 are joined by upstanding end edges 7 and 8 while upper edge means 5 and lower edge means 6 are joined by upstanding end edges 9 and 10 for wall means 1. Wall means 1 and 2 are spaced apart a distance X, and in this space is disposed trough means 11 which is open topped and carried in the space between wall means 1 and 2 above lower edges 4 and 6 and below upper edges 3 and 5. Trough 11 is also disposed in such space so as not to touch either of wall means 1 and 2 as will be shown hereinafter in FIG. 2.

Combustion trough 11 is composed of upwardly diverging side means 12 and 13 which extend for a substantial portion if not all of the long axis length L of wall means 1 and 2. Side means 12 and 13 terminate at their top edges 14 and 15, respectively, so that said top edges are spaced inwardly from wall means 1 and 2 a finite distance Y as shown in FIG. 3. Distance Y provides a gap between top edges 14 and 15 and wall means 1 and 2 so that a continuously moving curtain of oxygen containing gas can be established completely around the long axis of trough mean 11 but between wall means 1 and 2, as will be shown in greater detail in FIG. 2.

Side means 12 and 13 terminate at or near their bottom edges 16 and 17, respectively, on at least one conduit means 18, conduit means 18 extending for essentially the entire length of trough means 11. Conduit means 18 has a plurality of aperatures (FIG. 3) along the length thereof for admitting at least one fluid to the interior 19 (FIG. 2) of trough means 11 and between upwardly diverging side means 12 and 13. Side means 12 and 13 are joined at both ends of trough means 11 by end means 20 and 21 which define a closed interior 19 (except for open top 22 of trough means 11).

Figure 2:
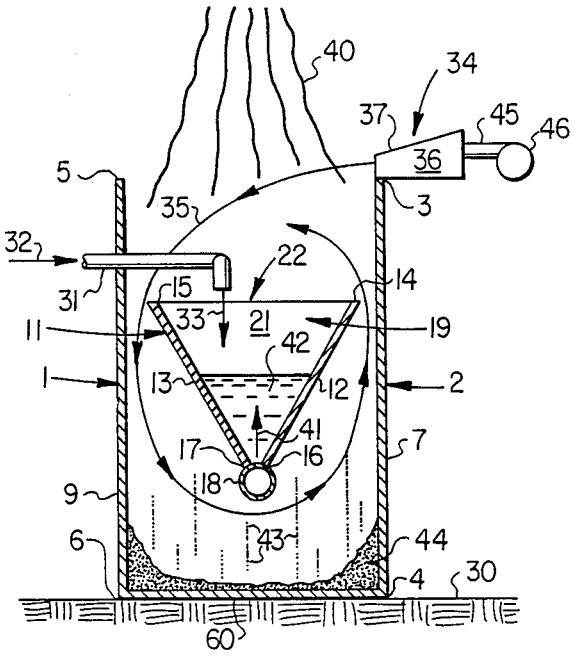
FIG. 2 is an end view of the equipment of FIG. 1 with the addition of feed means for the material to be combusted and means for establishing the aforementioned curtain.
Figure 3:
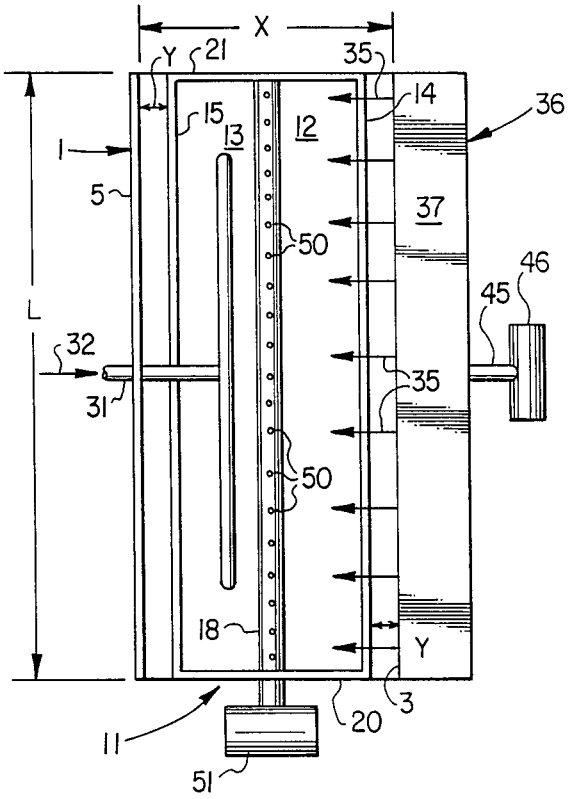
FIG. 3 is a top view of equipment of FIG. 3.

FIG. 2 shows a cross sectional end view of the device of FIG. 1 when sitting on the earth 30 and with the addition of a material feed means conduit 31 by which hydrocarbonaceous material to be combusted can be fed to closed interior 19 of trough means 11 as shown by arrows 32 and 33, and means 34 for establishing a continuously moving curtain of oxygen containing gas such as air 35 around trough means 11 and between wall means 1 and 2. The apparatus for establishing air curtain 35 is composed of a manifold means 36 which extends essentially the entire length L of wall means 2 and which contains baffle means 37 for directing the flow of air being admitted from manifold 36 downwardly towards but over open top 22 of trough means 11. This way, the air curtain will pass over the top of trough meas 11 hetween top edge 15 and wall means 1 in gap Y, around the under side of trough means 11 towards wall means 2, upwardly through gap Y between top edge 14 and wall means 2, and back to and over the open top 22 of trough means 11.

The volume and velocity of air or other gas used to form curtain 35 is adjusted so that some combustion products escape through curtain 35 overhead of the apparatus of this invention in the form of smoke 40. If (i) the quantity and velocity of fluid 41 that is emitted from one or more conduit means 18 to mix with the feed material 42 in trough 11, and (ii) the quantity and velocity of the gas making up curtain 35 are all coordinated with the particular combustion charactersstics of material 42, smoke 40 can be converted from a normal black color to a lighter color such as various shades of gray or even approaching white, thereby yielding tangible proof that visible emissions are being reduced by way of more complete combustion due to recycling of combustion products by way of curtain 35 and the removal of solid particulate material that drops out of air curtain 35 below trough means 11 as shown at 43. Removed solid particulate material is collected on top of ground 30 between wall means 1 and 2 as shown at 44 (FIG. 2). Manifold xeans 36 is supplied with air or other gas by way of conduit means 45 which is connected to the interior of manifold 36 and to a fluid pump means 46.

Figure 4:
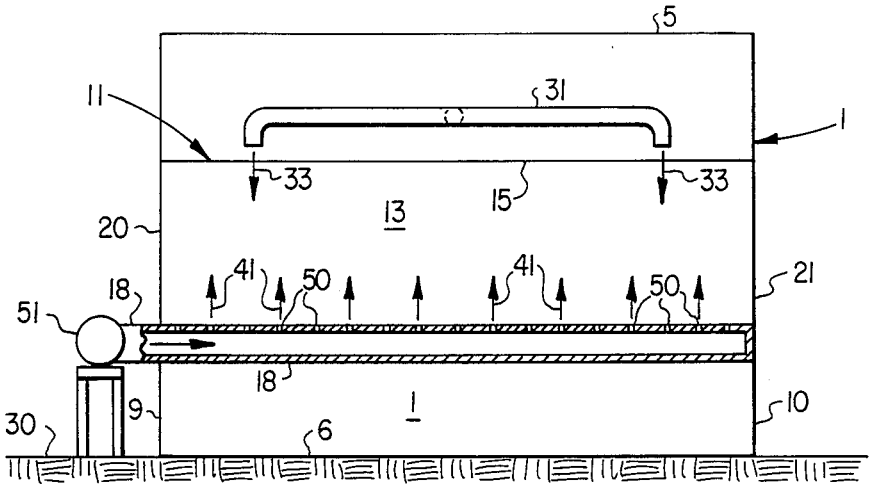
FIG. 4 is a side view of equipment of FIG. 3.

FIG. 3 is a top view of the apparatus of FIG. 2 and shows that conduit feed means 31 is formed in a T-configuration to provide multiple feed outlets along the length of trough means 11 as shown better in FIG. 4. FIG. 3 further shows that the upper side of conduit means 18 in interior 19 of trough means 11 contains a plurality of aperatures 50 for admitting fluid to interior 19 of trough means 11 as indicated by arrow 41 in FIG. 2. FIG. 3 further shows that conduit means 18 can extend through end means 20 to the exterior of trough means 11 to operably connect with a fluid pump means 51 or other suitable device for admitting (i) gaseous and/or liquid fuel to interior 19 and/or (ii) an oxygen containing gas such as air to interior 19, all for mixing with the hydrocarbonaceous material 42 to be combusted in interior 19. Feed conduit means 31 is employed in the form of a T so that only a single string of conduit breaks air curtain 35 as shown in FIG. 2.

FIG. 4 shows a side view of a middle cross section of the apparatus of FIG. 3.

Figure 5:
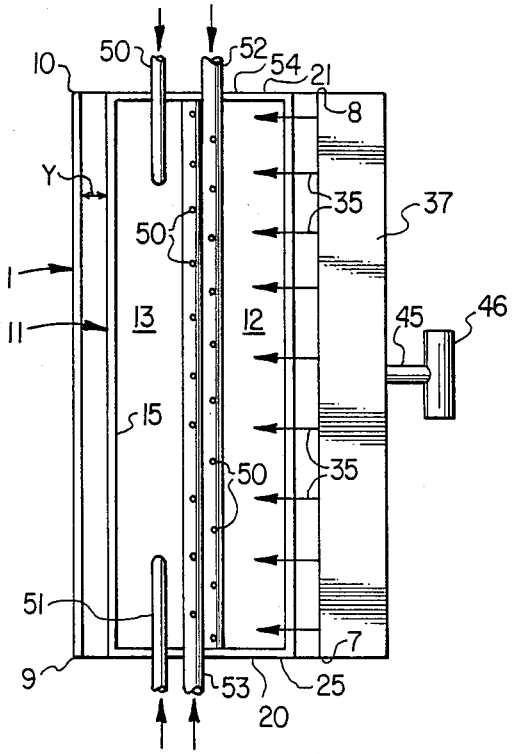
FIG. 5 is a top view of yet another embodiment of apparatus useful in this invention.

FIG. 5 shows a top view of the apparatus essentially as shown in FIGS. 1 through 4, except that it has been modified to provide a plurality of feed material means 50 and 51 which enter over end means 20 and 21 of trough means 11 so that feed means 50 and 51 do not interrupt air curtain 35 like feed means 31 does. The apparatus of FIG. 5 has also been modified to provide more than one conduit means 18 in a lower portion of trough means 11 as shown by conduit means 52 and 53. This way one fluid such as a gaseous fuel like natural gas, propane, and the like can be introduced into the interior of trough means 11 by way of conduit means 53 while at the same time or sequentially an oxygen containing gas such as air or diluted oxygen can be introduced into the interior of trough 11 by way of conduit means 52.

The apparatus of FIG. 5 has also been modified so that upstanding end edges 8 and 10 of wall means 2 and 1, respectively, are joined by an upstanding end closure means 54. Similarly, upstanding end edges 7 and 9 of wall means 2 and 1, respectively, are joined by upstanding end closure means 55 so that trough means 11 is enclosed on all four sides thereby providing a more captive volume for curtain 35 to be contained in and around trough means 11. If desired, a bottom means can be employed for any of the apparatus of this invention simply by providing a bottom means which connects lower edge means 6 and 4 of wall means 1 and 2, respectively, as shown by element 60 of FIG. 2 thereby providing a completely enclosed volume defined by wall means 1 and 2, and closure means 54 and 55, and bottom means 60, which volume contains trough means 11 and is open only at the top just as trough means 11 is open at its top.

Figure 6:
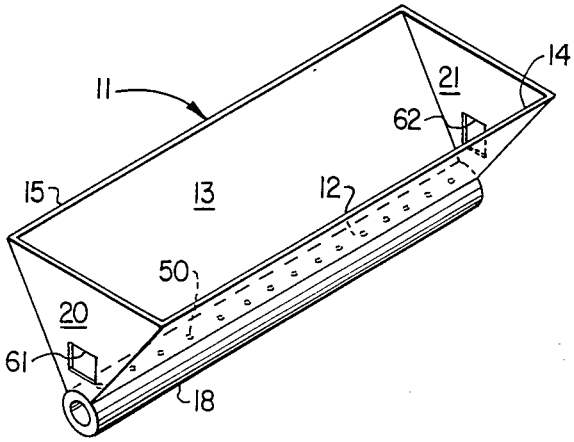
FIG. 6 an isometric view of a trough means within the scope of this invention which includes one form of cleanout means for the trough.

FIG. 6 shows trough means 11 modified so that end means 20 and 21 each contain an open port or a removable closure means 61 and 62 so that access to interior 19 of trough means 11 can be achieved for removing particulate and other material that tends to collect in trough means 11 after prolonged use. Of course, openings matching openings 61 and 62 in end means 20 and 21 may be provided in end closure means 54 and 55 of FIG. 5 if such closure means are present.

Figure 7:
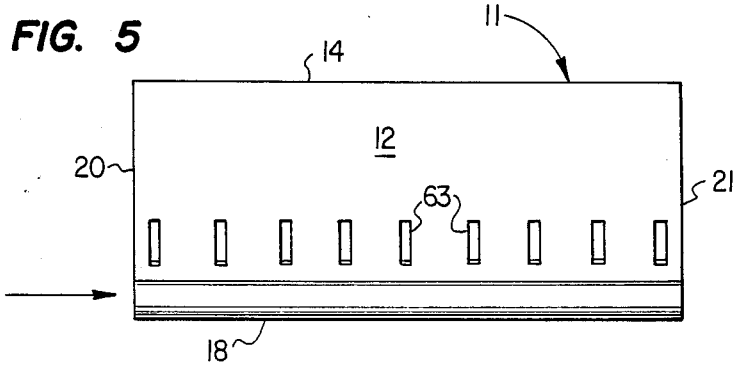
FIG. 7 is a side view of yet another trough means with yet another form of cleanout means for the trough.

FIG. 7 shows yet another cleanout modification that can be employed on trough means 11 which comprises a plurality of spaced apart aperatures 63 along one or both diverging side means 12 and 13 of trough means 11. Aperatures 63 can be open or carry a removable closure means so that access to interior 19 of trough means 11 can be achieved for removing material that may have accumulated in interior 19 due to prolonged combustion in interior 19.

Figure 8:
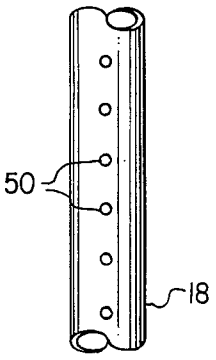
FIGS. 8 and 9 show various embodiments of conduit means useful in a lower portion of the trough means for introducing various fluids into the trough for mixing with the material to be combusted, and further show that various configurations of aperature arrangements can be employed in the conduit means.
Figure 9:
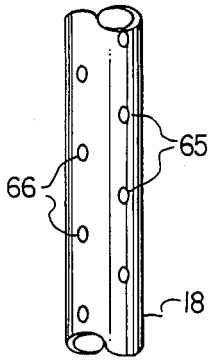

FIG. 8 shows an embodiment of conduit 18 wherein aperatures 50 are spaced apart in line along the longitudinal axis of conduit 18. This particular configuration of aperatures is not the only possible configuration useful in this invention, there being literally an infinite variety of arrangements for aperatures in conduit 18. For example, FIG. 9 shows a different arrangement, wherein aperatures 65 and 66 are spaced along either side of conduit 18, but yet still within interior 19, and staggered relative to one another. Nozzle means (not shown) can be employed with one or more aperature means 50, 55, and 60, if desired, to direct the flow of fluid in a certain direction and toward a certain point in interior 19, if desired.

Figure 10:
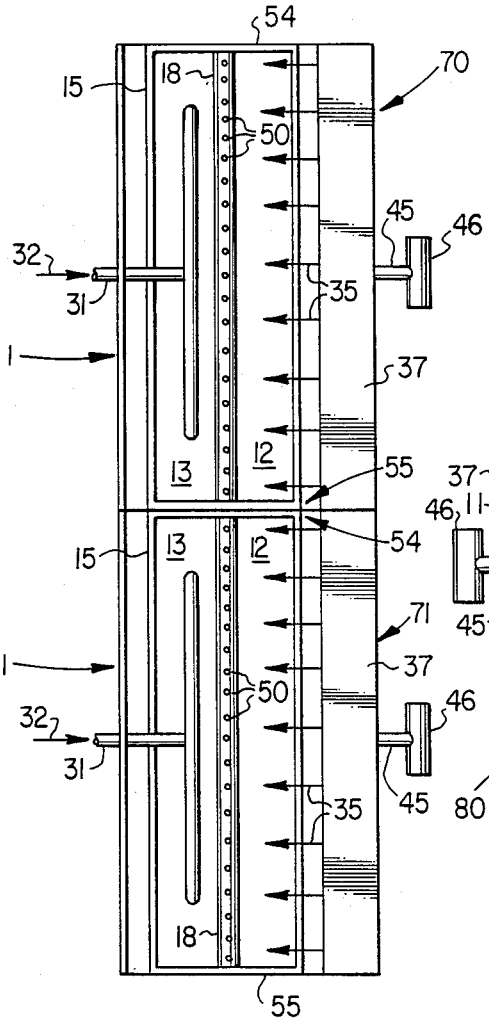
FIGS. 10 and 11 show that the equipment of this invention is modular in nature and can be ganged together in either series or parallel arrangement for increased processing capacity at a site where the accumulation to be diposed of is too large to be economically handled in a reasonable time period by the single module shown in FIGS. 1 through 5.

FIG. 10 shows how modules of this invention can be employed in series, if desired, to increase the combustion capacity of the apparatus of this invention. In this particular embodiment, duplicate modules of the single module of FIG. 5, the duplicate modules being represented as modules 70 and 71 in FIG. 10, are disposed so that upstanding end closure means 55 of module 70 abuts upstanding and enclosure means 54 of module 71. In this configuration, conduit means 18 of modules 70 and 71 can be connected together to form a single conduit throughout the length of combined modules 70 and 71. Of course, more than two modules can be combined together in this manner to provide a combustion device of any desired length and capacity.

Figure 11:
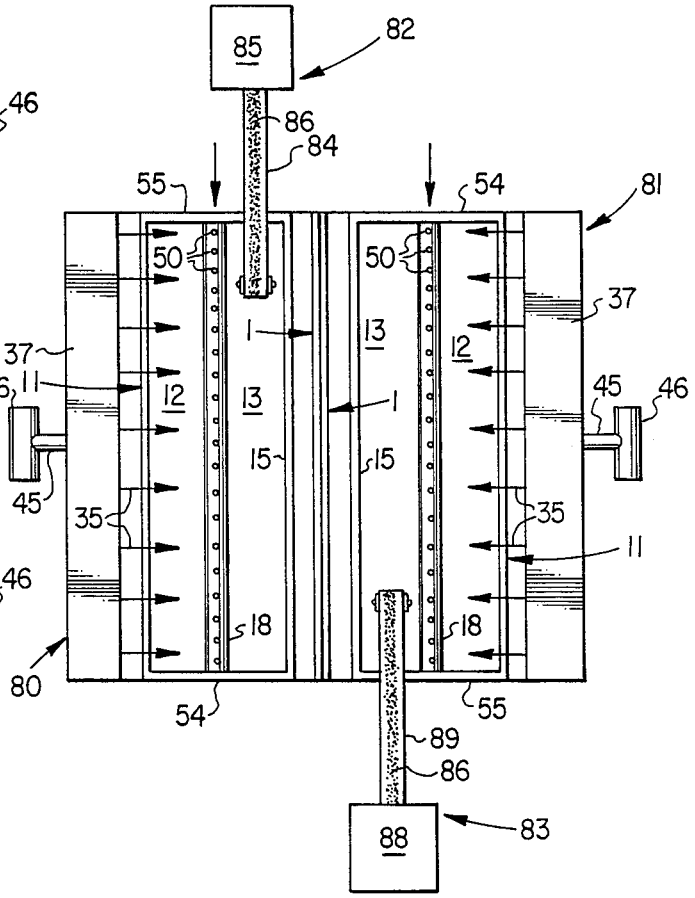

FIG. 11 employs a pair of modules similar to the single module shown for FIG. 5, but in parallel relationship. Thus, individual modules 80 and 81 of FIG. 11 are positioned side by side so that their wall means 1 are close, if not contiguous. In FIG. 11, the conduit type feed means shown in earlier FIGURES has been removed and a conventional conveyor belt type apparatus 82 for module 80 and 83 for module 81 have been installed. In particular for conveying apparatus 82, there is provided a continuous endless belt conveying means 84 which is connected to a conventional feed hopper 85 so that solid particulate waste material 86 can be conveyed from hopper 85 to the interior of trough means 11 by way of conveyer belt 84. Feed hopper 88 and conveying belt 89 are similarly employed for module 81. Of course, a plurality of modules can be connected in both the series and parallel configuration at the same time.

It can be seen that the feed material to the apparatus of this invention can be either solid, liquid, gaseous, or mixtures of two or more thereof. It can also be seen that an individual module or a plurality of individual modules can be highly mobile in that individual modules can be mounted on its own wheels or can be skid mounted and hauled from location to location by way of a trailer or light truck. Furrher, it is clear that rigging up a module to operate would not be a complex feat to achieve at a remote site, nor would operation of the appartus require sophisticated or involved equipment once the basic parameters of combustion, air flow, and the like through conduit means 18 and curtain 35 are achieved for the particular characteristics of the feed material to be consumed.

The particular chemical composition and combustion characteristics of a given feed material will vary widely from site to site and, therefore, quantification of air flows, temperatures, and the like for all possible feed materials is difficult at best if not impossible. However, it is equally as obvious that one skilled in the art armed with the details of this disclosure and the goals of same could adjust parameters and combinations of parameters until the desired combination of operating values for a specific feed material are found to yield the desired results of efficient and reasonably complete combustion with reduced visible emissions and substantial removal of particulates either in the combustion trough or below the combustion trough or both.

Generally, the feed material that can be burned in the apparatus and method of this invention will vary widely as to characteristic, composition, and the like. Generally, any liquid or relatively subdivided solid waste which contains a significant amount of one or more hydrocarbonaceous materials can be employed. Taking for example the oil patch, weathered oil, oil emulsified with water from a water flood or other production operation, oil based drilling mud, cuttings contaminated with oil based drilling mud, oil contaminated heater treater filter material, paraffin that has been separated from crude oil, waste oil cotaminated solids, tank bottoms, soil contaminated with hydrocarbons and the like can all be combusted by way of the method and apparatus of this invention.

Initial ignition of the feed material in the combustion trough can be achieved in any desirable way. For example, when a combustible fuel is not provided by way of conduit means 18, a lighter hydrocarbonaceous material such as gasoline, kerosene, diesel oil and the like can be mixed with and/or the feed material in trough 11 and then lit through the open top of the trough with a suitable torch. Some feed materials will be difficult to initiate combustion on and that is when the employment of a combustible gas in interior 19 to mix with feed material 42 same can aid ignition as well as maintenance of combustion throughout the cycle. The combustible gas employed by way of conduit 18 can be obtained from any suitable source such as a natural gas pipeline or gas well near the disposal site or by a butane or similar tank carried along with the module to the combustion site.

Air curtain 35 can be established by any conventionally known wind shear device and the gas used to make up the curtain can be air but is not necessarily limited to air. For example, it could employ air enriched with oxygen carried in tanks to the site or, similarly, enriched with an inert material such as nitrogen depending upon what is required to initiate and maintain sufficient combustion of the particular feed material under consideration. It is preferable to have as uniform an air curtain around trough 11 as possible. Therefore, if a feed device must necessarily penetrate air curtain 35, e.g., conduit means 31, it can be desirable to have the feed device, at least in the area where it penetrates the curtain, to be streamlined in an airfoil shape so that air flow turbulance in the area of and around the conduit means is minimized and laminar flow of curtain 35 around the feed means is maximized. It is important to note that in order to achieve the beneficial effects of this invention, the functional combination of both curtain 35 and fluids admitted by way of conduit 18 are necessary, and this particular combination must be tailored as to flow rates, volumes, temperatures, and the like to the particular, physical, chemical and combustion characteristics of the feed material to be consumed in the combustion trough. When efficient combustion is achieved, upon completion of the combustion cycle, all that will be left will be solid particulates, principally soil particles such as clay, sand, and the like or other noncombustible solids that are relatively clean of organic materials. This uncombusted residue, which is greatly reduced in both volume and weight compared to the original feed material, is essentially inert and can be relatively easily and inexpensively disposed of in an environmentally safe manner.

EXAMPLE

A mixture of crude oil and salt water which has essentially no light hydrocarbons such as methane, ethane, propane or other material having less than eight carbon atoms, and the like therein, and which has the physical consistency roughly of molasses is poured into the trough of apparatus substantially as shown in FIGS. 1 through 4 while natural gas is pumped through conduit 18 to mix with the feed material. After at least half of trough 11 is filled with feed material, the surface of the feed material in the trough is lit by dropping burning paper thereon and air curtain 35 then established. Once steady state combustion is achieved, the natural gas is gradually reduced and replaced with air so that combustion in trough 11 is sustained at the desired temperature and other equilibrium state by supplying oxygen from both air curtain 35 and conduit means 18. Air is emitted from manifold 37 through a slot which is as long as the manifold and approximately one inch in height and is directed toward the gap Y between wall means 1 and top edge 15. Additional feed material is supplied to trough 11 by way of conduit 31 at a rate which maintains the desired combustion equilibrium of yielding light colored smoke along with substantial consumption of hydrocarbons and removal of solid particulates.

Reasonable variations and modifications are possible within the scope of this disclosure without departing from the spirit and scope of this invention.

What is claimed is:

1. In apparatus for the combustion of a hydro-carbonaceous material to reduce visible emissions and remove at least some particulate solids, the improvement comprising a pair of spaced apart upstanding elongate wall means having upper and lower longitudinally extending edge means joined by upstanding end edges, said spaced apart wall means being adapted to contain and direct an oxygen containing gas curtain in the space between same, an elongate combustion trough means carried in said space between said spaced apart wall means, said trough means being spaced above said lower edge and below said upper edge of said spaced apart wall means and extending for a substantial portion of the length of said spaced apart wall means, said trough means comprising upwardly diverging side means which extend for a substantial portion of the length of said spaced apart wall means, said side means terminating at their top edge so that said top edge is spaced inwardly from said spaced apart wall means to provide a gap between said top edge and said spaced apart wall means through which said gas curtain can pass, said side means terminating near their bottom edges on at least one conduit means, each said conduit means extending essentially the length of said trough means and having a plurality of aperatures along the length thereof for admitting at least one fluid to the interior of said trough means between said side means, said side means being joined at both ends of said trough means by end means which define a closed interior for said trough means, means for feeding combustible material to said closed interior of said trough means, and means for establishing said oxygen containing gas curtain around said trough means and between said spaced apart wall means.

2. The apparatus of claim 1 wherein said upstanding end edges at both ends of said upstanding wall means are joined by upstanding end closure means which define a closed interior volume which contains said trough means and which is open at the top.

3. The apparatus of claim 2 wherein said upstading wall means are joined at their lower edge means to define a bottom means.

4. The apparatus of claim 1 wherein said means for establishing said oxygen containing gas curtain around said trough means is carried at an upper edge means of one of said upstanding spaced apart wall means, and is oriented to blow gas across the open top of said trough means, against the opposing wall means, under said trough means, against the wall means which carries said means for establishing said curtain, and back to the top of said trough means.

5. The apparatus of claim 1 wherein at least one of said upwardly diverging side means and said end means contain at least one aperature for removal of material that may collect in the closed interior ot saic trough means.

* * * * *